US010218077B2

(12) United States Patent
Lepe et al.

(10) Patent No.: US 10,218,077 B2
(45) Date of Patent: Feb. 26, 2019

(54) WIRELESS COMMUNICATION DEVICE HAVING A MULTI-BAND SLOT ANTENNA WITH A PARASITIC ELEMENT

(71) Applicant: TYCO ELECTRONICS CORPORATION, Berwyn, PA (US)

(72) Inventors: Hilario Lepe, Gilroy, CA (US); Bruce Foster Bishop, Aptos, CA (US)

(73) Assignee: TE Connectivity Corporation, Berwyn, PA (US)

( * ) Notice: Subject to any disclaimer, the term of this patent is extended or adjusted under 35 U.S.C. 154(b) by 127 days.

(21) Appl. No.: 15/228,641

(22) Filed: Aug. 4, 2016

(65) Prior Publication Data

US 2018/0040942 A1 Feb. 8, 2018

(51) Int. Cl.

| | |
|---|---|
| ***H01Q 13/10*** | (2006.01) |
| ***H01Q 5/378*** | (2015.01) |
| ***H01Q 1/22*** | (2006.01) |
| ***H01Q 1/24*** | (2006.01) |
| ***H01Q 21/28*** | (2006.01) |
| ***H01Q 5/371*** | (2015.01) |

(52) U.S. Cl.

CPC ..... *H01Q 13/106* (2013.01); *H01Q 1/2266* (2013.01); *H01Q 1/243* (2013.01); *H01Q 1/245* (2013.01); *H01Q 5/371* (2015.01); *H01Q 5/378* (2015.01); *H01Q 21/28* (2013.01)

(58) Field of Classification Search

CPC ..... H01Q 1/243; H01Q 5/378; H01Q 5/385; H01Q 5/392; H01Q 13/10; H01Q 13/106; H01Q 13/18

See application file for complete search history.

(56) References Cited

U.S. PATENT DOCUMENTS

| | | | | |
|---|---|---|---|---|
| 8,599,089 | B2 | 12/2013 | Bevelacqua et al. | |
| 8,665,164 | B2 | 3/2014 | Hill et al. | |
| 8,896,487 | B2 | 11/2014 | Chiang et al. | |
| 9,070,985 | B2 | 6/2015 | Wang | |
| 9,196,966 | B1 | 11/2015 | Obeidat | |
| 9,203,139 | B2 | 12/2015 | Zhu et al. | |
| 9,236,648 | B2 | 1/2016 | Guterman et al. | |
| 2002/0021250 | A1 | 2/2002 | Asano et al. | |
| 2012/0068893 | A1* | 3/2012 | Guterman | H01Q 1/2266 343/702 |
| 2014/0111388 | A1* | 4/2014 | Di Nallo | H01Q 1/2266 343/702 |
| 2017/0054196 | A1* | 2/2017 | Hu | H01Q 1/243 |

* cited by examiner

*Primary Examiner* — Robert Karacsony

(57) ABSTRACT

Wireless communication device includes a conductive wall having an antenna slot. The wireless communication device also includes an antenna sub-assembly positioned relative to the antenna slot to form a multi-band slot antenna. The multi-band slot antenna includes a dielectric body and a feed trace coupled to the dielectric body. The feed trace is operably aligned with the antenna slot. The multi-band slot antenna also includes a parasitic trace coupled to the dielectric body. The parasitic trace is operably aligned with the antenna slot and spaced apart from the feed trace. The feed trace is configured to communicate at a first frequency band and the parasitic trace enables the multi-band slot antenna to communicate at a second frequency band. The first frequency band is based on a size and shape of the parasitic trace.

20 Claims, 5 Drawing Sheets

WIRELESS COMMUNICATION DEVICE HAVING A MULTI-BAND SLOT ANTENNA WITH A PARASITIC ELEMENT

BACKGROUND

The subject matter relates generally to wireless communication devices and to multi-band slot antenna assemblies that may be used by wireless communication devices.

Wireless communication devices are increasingly used by consumers and have an expanding number of applications within a variety of industries. Examples of such wireless devices include mobile phones, tablet computers, notebook computers, laptop computers, and handsets. These devices often include one or more integrated antennas that allow for wireless communication within a communication network. Recently, there have been two conflicting market demands for wireless devices. Users generally demand wireless devices that are smaller or weigh less, but the users also desire better performance and/or a greater number of capabilities. For example, wireless devices now operate within multiple frequency bands and are capable of selecting such bands for different networks. Features that have improved recently include data storage, battery life, and camera performance, among other things.

To provide smaller devices with improved performances and more capabilities, manufacturers have attempted to optimize the available space within the wireless device by resizing components of the wireless device or by moving the components to different locations. For example, the size and shape of the antenna may be reconfigured and/or the antenna may be moved to a different location. The number of available locations for an antenna, however, is limited not only by other components of the wireless device, but also by government regulations and/or industry requirements, such as those relating to SAR. With respect to portable computers, such as laptops, notebooks, tablets, and convertible computers that can operate in laptop or tablet modes, antennas are typically positioned either within a section of the computer that includes a display or a base section that includes the keyboard. Although these antennas can be effective, alternative antennas that provide sufficient communication while occupying less space allowing other device designs are desired.

BRIEF DESCRIPTION

In an embodiment, a wireless communication device is provided that includes a conductive wall having an antenna slot. The wireless communication device also includes an antenna sub-assembly positioned relative to the antenna slot to form a multi-band slot antenna. The multi-band slot antenna includes a dielectric body and a feed trace coupled to the dielectric body and electrically coupled to a conductive pathway for communicating radio-frequency (RF) waves. The feed trace is operably aligned with the antenna slot. The multi-band slot antenna also includes a parasitic trace coupled to the dielectric body. The parasitic trace is operably aligned with the antenna slot and spaced apart from the feed trace. The feed trace is configured to communicate at a first frequency band and the parasitic trace enables the multi-band slot antenna to communicate at a second frequency band. The first frequency band is based on a size and shape of the parasitic trace.

In some aspects, the feed trace is configured to communicate at a third frequency band. The second and third frequency bands may be greater than the first frequency band.

In some aspects, the parasitic trace permits a length of the antenna slot to be shorter compared to the length of the antenna slot if the multi-band slot antenna did not include the parasitic trace.

In some aspects, the wireless communication device includes a housing section that defines an exterior of the wireless communication device. The housing section may include the conductive wall and the antenna slot. The conductive wall may be a structural element of the wireless communication device. Optionally, the antenna slot opens to the exterior of the wireless communication device.

Optionally, the housing section defines a housing cavity. The dielectric body may include a dielectric insert that is either disposed in the housing cavity and engaging the housing section through an interference fit or molded with the housing section.

In some aspects, the wireless communication device may also include a cover shell that has the housing section and a user display that is protected by the cover shell. Optionally, the wireless communication device may be a portable computer. The cover shell may be configured to rotate between positions to change the portable computer between an open operating state and a tablet operating state.

In some aspects, the wireless communication device is a portable computer having first and second device sections rotatably coupled to one another through a hinge assembly. The housing section may define a portion of the hinge assembly.

In some aspects, the wireless communication device also includes a printed circuit that includes the dielectric body, the feed trace, and the parasitic trace. The printed circuit may overlap with the antenna slot.

In some aspects, the multi-band slot antenna is a first multi-band slot antenna. The wireless communication device may include a second multi-band slot antenna. The second multi-band slot antenna may include a corresponding antenna slot, a corresponding feed trace, and a corresponding parasitic trace.

In an embodiment, a multi-band slot antenna is provided that includes a conductive wall having an antenna slot. The multi-band slot antenna also includes a dielectric body and a feed trace coupled to the dielectric body and configured to be electrically coupled to a conductive pathway for communicating radio-frequency (RF) waves. The feed trace is operably aligned with the antenna slot. The multi-band slot antenna also includes a parasitic trace coupled to the dielectric body. The parasitic trace is operably aligned with the antenna slot and spaced apart from the feed trace. The feed trace is configured to communicate at a first frequency band and the parasitic trace enables the multi-band slot antenna to communicate at a second frequency band. The first frequency band is based on a size and shape of the parasitic trace.

In some aspects, the feed trace is configured to communicate at a third frequency band. The second and third frequency bands may be greater than the first frequency band.

In some aspects, the parasitic trace permits a length of the antenna slot to be shorter compared to the length of the antenna slot if the multi-band slot antenna did not include the parasitic trace.

In some aspects, the conductive wall is a portion of a housing section of a wireless communication device.

In some aspects, the multi-band slot antenna also includes a printed circuit that includes the dielectric body, the feed trace, and the parasitic trace.

In some aspects, the housing section defines a portion of a hinge assembly.

In an embodiment, an antenna sub-assembly is provided that includes a dielectric body and a feed trace coupled to the dielectric body and configured to be electrically coupled to a conductive pathway for communicating radio-frequency (RF) waves. The antenna sub-assembly also includes a parasitic trace coupled to the dielectric body. The parasitic trace is spaced apart from the feed trace and has a fixed position with respect to the feed trace. The feed trace and the parasitic trace are configured to be operably positioned relative to a common antenna slot to form a multi-band slot antenna. The feed trace is configured to communicate at a first frequency band. The parasitic trace enables the multi-band slot antenna to communicate at a second frequency band. The first frequency band is based on a size and shape of the parasitic trace.

In some aspects, the feed trace is configured to communicate at a third frequency band. The second and third frequency bands may be greater than the first frequency band.

In some aspects, the parasitic trace permits a length of the antenna slot to be shorter compared to the length of the antenna slot if the antenna sub-assembly did not include the parasitic trace.

DETAILED DESCRIPTION

Figure 1:
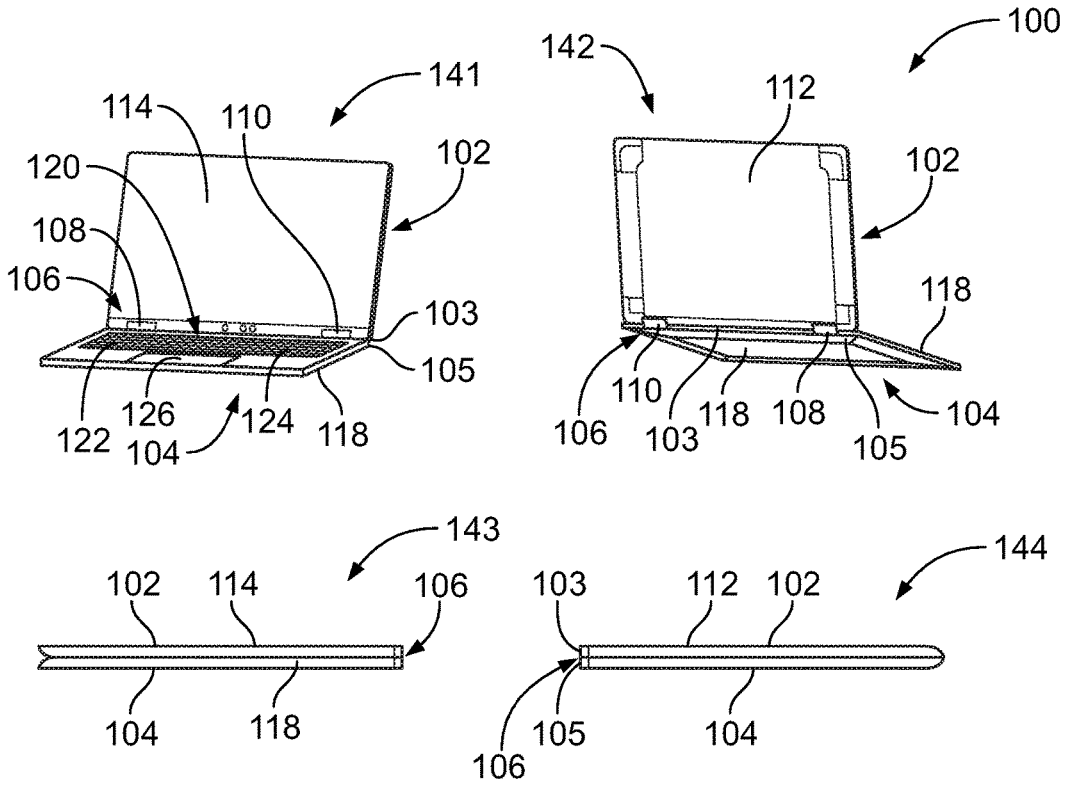
FIG. 1 illustrates a wireless communication device in accordance with an embodiment that includes a multi-band slot antenna as set forth herein.

Embodiments set forth herein include multi-band slot antennas and wireless communication devices having multi-band slot antennas. A wireless communication device is hereinafter referred to as a wireless device. In some embodiments, the multi-band slot antenna is formed with a designated section of the wireless device. For example, the wireless device may be a portable computer having one or more sections that may come in contact with an individual. Alternatively, the multi-band slot antenna may be formed with an interior section of the wireless device. As used herein, a "portable computer" includes a laptop computer, a notebook computer, a tablet computer, and the like. In particular embodiments, the portable computer is similar to a laptop or notebook computer and is capable of being converted into a tablet-like computer. In other embodiments, the portable computer is a laptop or notebook computer. The portable computer may have discrete movable device sections. For instance, the portable computer may include a base section having, among other things, a keyboard. The portable computer may also include a display section that includes, among other things, a user display (e.g., touch-screen). The base and display sections may be rotatably coupled to one another.

The wireless device may include a system or device ground and multi-band slot antenna that is electrically coupled to the system ground. In some embodiments, the system ground has an area that is significantly larger than the conductive elements of the multi-band slot antenna, such as feed and parasitic traces. The system ground may be, for example, one or more sheets of conductive metal. The system ground may be electrically coupled to other elements of the wireless device, such as a housing of a portable computer.

In some embodiments, the multi-band slot antenna includes an antenna slot that is defined by a conductive wall. Optionally, the conductive wall may form at least a portion of a structural element of the wireless device. The multi-band slot antenna also includes a dielectric body that is coupled to the feed and parasitic traces. In particular embodiments, the multi-band slot antenna includes a printed circuit board having the dielectric body and the feed and parasitic traces. In such embodiments, the printed circuit board may be manufactured using printed circuit technology.

It should be understood, however, that the multi-band slot antenna may be manufactured through other methods. One or more elements of the multi-band slot antenna may be manufactured through laser direct structuring (LDS), two-shot molding (dielectric with copper traces), and/or ink-printing. For example, dielectric structures may be manufactured by molding a dielectric body (e.g., thermoplastic) into a designated shape. Conductive elements (e.g., ground traces, feed traces, parasitic traces, or other traces) may then be disposed on surfaces of the mold through, for example, ink-printing. Alternatively, conductive elements may be first formed and then a dielectric body may be molded around the conductive components. For example, the conductive elements (e.g., ground traces, feed traces, parasitic traces, or other traces) may be stamped from sheet metal, disposed within a cavity, and then surrounded by a thermoplastic material that is injected into the cavity. The dielectric body may include only a single dielectric element or may include a combination of dielectric elements.

The multi-band slot antenna may include a plurality of levels or layers in which at least one of the levels or layers has one or more feed traces (or pads) capable of communicating at a designated radio frequency (RF) frequency or band. For purposes of the present disclosure, the term "RF" is used broadly to include a wide range of electromagnetic transmission frequencies including, for instance, those falling within the radio frequency, microwave or millimeter wave frequency ranges. The multi-band slot antenna also includes one or more parasitic traces (or pads) that are positioned relative to the feed traces and to the antenna slot to achieve a designated performance of the multi-band slot antenna.

The multi-band slot antenna has at least two different frequency bands, such as 704-960 MHz, 1425-1850 MHz, and 1850-2700 MHz. The range of frequencies of the multi-band slot antenna may be applicable to, for example, a wireless local area network (WLAN) system. In some embodiments, the multi-band slot antenna has one or more center frequencies within the range of 2.4-2.484 GHz and one or more center frequencies within the range of 5.15-5.875 GHz. For example, the multi-band slot antenna may have a first frequency band that is centered at 2.4 GHz, a second frequency band that is centered at 5.3 GHz, and a third frequency band that is centered at 5.6 GHz. It should be understood, however, that wireless devices and multi-band slot antennas described herein are not limited to particular frequency bands and other frequency bands may be used. Likewise, it should be understood that wireless devices and multi-band slot antennas described herein are not limited to particular wireless technologies (e.g., WLAN, Wi-Fi, WiMax) and other wireless technologies may be used.

FIG. 1 illustrates different views of a wireless communication device 100 formed in accordance with an embodiment. The wireless communication device 100 is hereinafter referred to as a wireless device. In an exemplary embodiment, the wireless device 100 is a convertible portable computer that is capable of being repositioned to operate in different states or modes. For example, FIG. 1 illustrates front and rear perspective views 141, 142, respectively, of the wireless device 100 in a first operating state. FIG. 1 also illustrates side views 143, 144 of the wireless device 100 in second and third operating states, respectively. The first operating state may be referred to as an open operating state in which an individual may, for example, type on a keyboard and/or view or touch a user display. The second operating state may be referred to as a tablet operating state in which the individual may interact with (e.g., view and/or touch) the user display. The third operating state may be referred to as a closed operating state.

In other embodiments, however, the wireless device 100 may have only two operating states or only one operating state. For example, the wireless device 100 may be a portable computer that can only operate in the open and closed operating states, or the wireless device 100 may be a tablet computer (or smart phone) that can only operate in the tablet operating state. Yet in other embodiments, the wireless device may be a wearable device (e.g., watch, fitness tracker, health status monitor, and the like). The wearable device may be integrated with other wearable elements, such as clothing.

The wireless device 100 may include multiple interconnected device sections that are movable with respect to each other. In an exemplary embodiment, the wireless device 100 includes a first device section 102 and a second device section 104 that are interconnected to each other through a hinge assembly 106. The first device section 102 has a first edge 103, and the second device section has a second edge 105. The hinge assembly 106 may interconnect the first and second edges 103, 105 and permit the first and second device sections 102, 104 to rotate about an axis between the open operating state, the closed operating state, and the tablet operating state. In the illustrated embodiment, the hinge assembly 106 includes two hinges 108, 110. Portions of the hinges 108, 110 may be defined by the first device section 102 and complementary portions of the hinges 108, 110 may be defined by the second device section 104. In alternative embodiments, the hinge assembly 106 is a floating hinge having two axes of rotation.

The first device section 102 includes a cover shell 112 and a user display 114. The user display 114 is configured to face the individual during an operating state (e.g., the first and second operating states). In the first or third operating states, the cover shell 112 may define an exterior of the wireless device 100. In the second operating state, the cover shell 112 is positioned between the user display 114 and the second device section 104. In an exemplary embodiment, the cover shell 112 includes antenna slots 212, 214 (shown in FIG. 5) that interact with corresponding feed traces and parasitic traces (described below) to form one or more multi-band slot antennas.

The antenna slots may be defined by the cover shell 112, which has a structural purpose other than forming the antenna slots. More specifically, the cover shell 112 (1) forms a portion of the exterior of the wireless device 100, (2) protects interior components of the wireless device 100, and (3) supports the user display 114. The user display 114 may be a liquid crystal display (LCD) and include glass (e.g., alkali-aluminosilicate sheet glass). In other embodiments, the antenna slots may be defined by other structural elements of the wireless device 100. For example, the antenna slots may be defined by a housing 118 of the second device section 104. Alternatively, the antenna slots may be defined by other structural elements of the wireless device 100.

As used herein, a "structural element" is an element that includes a metal material defining the antenna slot (or slots). The structural element must also enhance the structural integrity of the wireless device 100 and/or protects at least one component of the wireless device, wherein the protected component is other than the multi-band slot antenna. A structural element enhances the structural integrity of the wireless device 100 if the structural element is designed to support a load of the wireless device 100. As described herein, the structural element may be the housing of one of the device sections. Other examples of structural elements include an interior frame and/or a conductive wall. It is noted, however, that a conductive wall is not required to be a structural element, unless stated to the contrary (e.g., "further comprising a structural element that includes the conductive wall . . . ").

Structural elements may be molded, stamped-and-formed, die cast, and/or the like. Structural elements may have a uniform composition throughout such that the portion of the structural element that defines the antenna slot has the same composition as a separate portion that, for example, enhances the structural integrity of the wireless device. Structural elements may have portions that define an exterior of the wireless device. The exterior includes the surfaces exposed to the surrounding environment during at least one operating state.

In an exemplary embodiment, the user display 114 is a touchscreen that is capable of detecting a touch from a user and identifying a location of the touch within the display area. The touch may be from a user's finger and/or a stylus or other object. The user display 114 may implement one or more touchscreen technologies. In other embodiments, however, the user display 114 is not a touchscreen that is capable of identifying touches. For example, the user display 114 may only be capable of displaying images.

The second device section 104 has an interactive side 120 that includes a user interface 122. The user interface 122 may include one or more input devices. For example, the user interface 122 includes a keyboard 124 and a touchpad 126 that are communicatively coupled to system circuitry 130 (shown in FIG. 2) of the wireless device 100. Each of the keyboard 124 and the touchpad 126 is configured to receive user inputs from a user of the wireless device 100.

The housing 118 surrounds and protects at least some of the system circuitry 130 of the wireless device 100. The second device section 104 may also include ports that allow other devices or networks to communicatively couple to the wireless device 100. Non-limiting examples of external devices include removable media drives, external keyboards, a mouse, speakers, and cables (e.g., Ethernet cable). Although not shown, the second device section 104 may also be configured to be mounted to a docking station and/or charging station.

Figure 2:
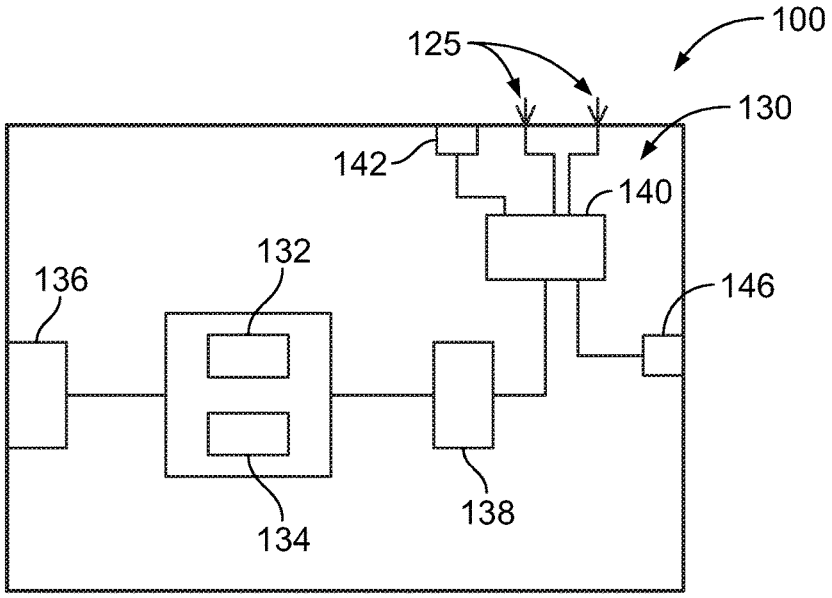
FIG. 2 is a block diagram of the wireless communication device of FIG. 1.

FIG. 2 is a block diagram of the wireless device 100 illustrating the system circuitry 130 in greater detail. The system circuitry 130 is communicatively coupled to the multi-band slot antennas 125 and may control operation of the multi-band slot antennas 125. Although two multi-band slot antennas 125 are shown in FIG. 2, other embodiments may include only one multi-band slot antenna or more than two multi-band slot antenna. The multi-band slot antennas 125 may communicate with the same frequency bands or communicate with different frequency bands.

The system circuitry 130 may include one or more processors 132 (e.g., central processing units (CPUs), microcontrollers, field programmable arrays, or other logic-based devices), one or more memories 134 (e.g., volatile and/or non-volatile memory), and one or more data storage devices 136 (e.g., removable storage device or non-removable storage devices, such as hard drives). The data storage device 136 may be computer readable media on which is stored one or more sets of instructions. The instructions may reside, completely or at least partially, within the data storage devices 136, memories 134, and/or within the processor(s) 132. The system circuitry 130 may also include a wireless control unit 138 (e.g., mobile broadband modem) that enables the wireless device 100 to communicate via a wireless network. The wireless device 100 may be configured to communicate according to one or more communication standards or protocols (e.g., Wi-Fi, Bluetooth, cellular standards, etc.).

During operation of the wireless device 100, the wireless device 100 may communicate with external devices or networks through the multi-band slot antennas 125. To this end, the multi-band slot antennas 125 may include conductive elements that are configured to exhibit electromagnetic properties that are tailored for desired applications. For instance, each of the multi-band slot antennas 125 may be configured to operate in multiple frequency bands simultaneously. The structure of the multi-band slot antennas 125 can be configured to effectively operate in particular radio bands. The structure of the multi-band slot antennas 125 can be configured to select specific radio bands for different networks. The multi-band slot antennas 125 may be configured to have designated performance properties, such as a voltage standing wave ratio (VSWR), gain, bandwidth, and a radiation pattern. In some embodiments, the multi-band slot antennas 125 operate at identical center frequencies (or identical frequency bands). In other embodiments, however, the multi-band slot antennas 125 operate at different center frequencies (or different frequency bands).

The wireless device 100 may also include a power-control circuit 140 and one or more proximity sensors 146 that are configured to detect when an individual's body, including skin or clothing, is adjacent to the wireless device 100. For example, the proximity sensors 146 may be infrared (IR) sensors or capacitive sensors that detect when an individual's skin is within a certain distance from the multi-band slot antenna 125 and/or one or more sections of the wireless device 100, such as the first or second device sections 102, 104 (FIG. 1). As shown, the proximity sensors 146 are illustrated as simple blocks, like other circuitry. It should be understood, however, that the proximity sensors 146 may have any structure in accordance with the type of proximity sensor. The proximity sensor 146 is communicatively coupled to the power-control circuit 140 that, in turn, is communicatively coupled to the multi-band slot antennas 125. More specifically, the power-control circuit 140 is capable of reducing power to the multi-band slot antennas 125 in order to reduce RF emissions. In some embodiments, the power reduction may be localized to certain spaces and/or applied to only a select number of the available frequency bands. Although the power-control circuit 140 is illustrated as being positioned between the multi-band slot antennas 125 and the wireless control unit 138, the power-control circuit 140 may have other positions. For example, the power-control circuit 140 may be a part of the wireless control unit 138.

Embodiments set forth herein may be configured to achieve designated specific absorption rate (SAR) limits. In particular, the multi-band slot antenna and/or power-control circuit may be configured to achieve designated SAR limits. SAR is a measure of the rate that RF energy is absorbed by a body. In some cases, an allowable SAR limit from wireless devices is 1.6 watts per kilogram (W/kg), as averaged over one gram of tissue. However, the SAR limit may change based upon application of the wireless device, government regulations, industry standards, and/or future research regarding RF exposure. In particular embodiments, the multi-band slot antenna and/or power-control circuit are configured for zero clearance when an individual's body is determined to be adjacent to a designated area of the wireless device, such as the multi-band slot antenna.

The SAR limits may depend upon the application of the wireless device. The SAR for one or more embodiments may be determined in accordance with one or more protocols, such as those provided by industry and/or government agencies. By way of example, embodiments set forth herein may be tested and/or configured to satisfy the SAR-related standards set forth by the U.S. Federal Communications Commission (FCC).

Figure 3:
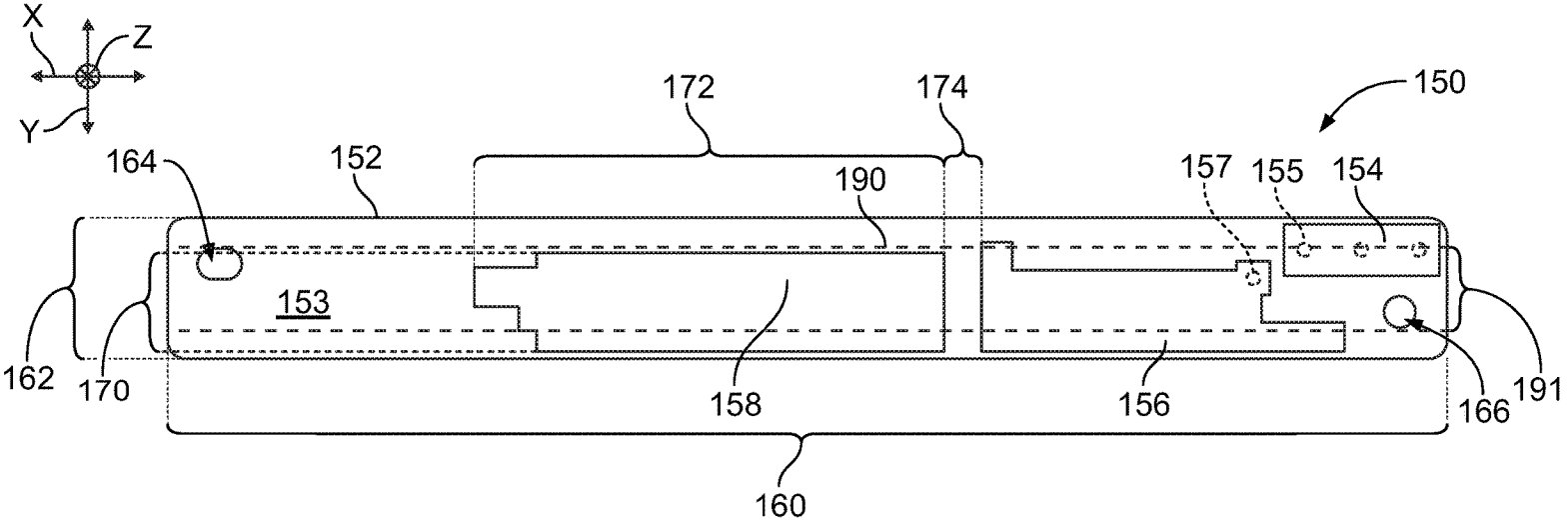
FIG. 3 is a plan view of an antenna sub-assembly that may be used to form a first multi-band slot antenna that may be used with the wireless communication device of FIG. 1, according to a specific embodiment.
Figure 4:
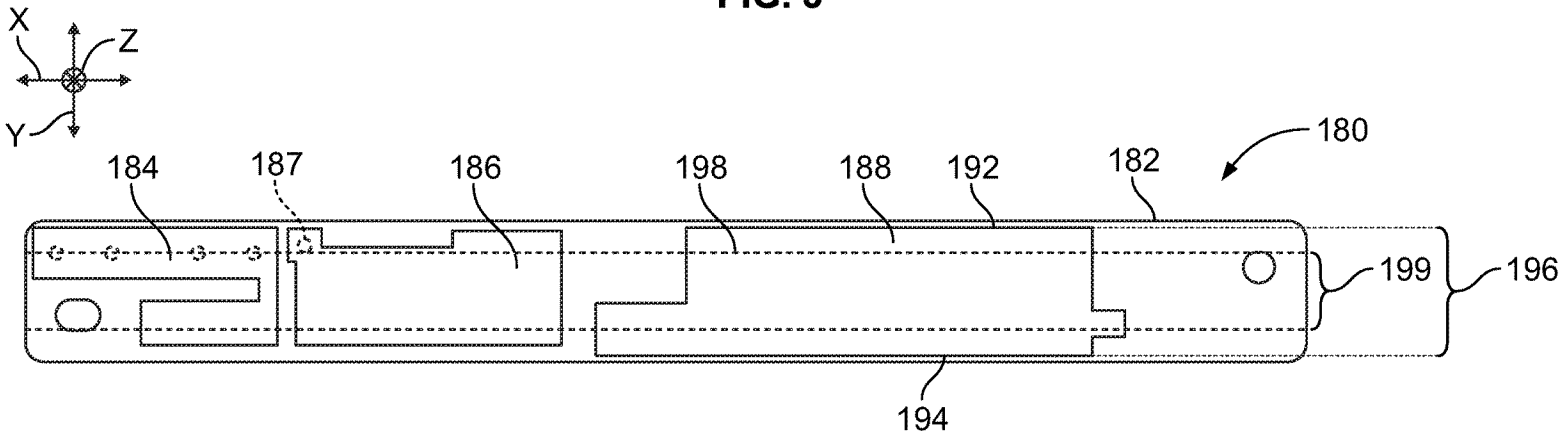
FIG. 4 is a plan view of an antenna sub-assembly that may be used to form a second multi-band slot antenna that may be used with the wireless communication device of FIG. 1, according to a specific embodiment.

FIG. 3 is a top plan view of an antenna sub-assembly 150 formed in accordance with an embodiment, and FIG. 4 is a top plan view of an antenna sub-assembly 180 in accordance with an embodiment. The antenna sub-assemblies 150, 180 may form portions or parts of respective multi-band slot antennas, such as the multi-band slot antennas 125 (FIG. 2), and may be similar or identical to the antenna sub-assemblies 232, 234 (shown in FIG. 6).

The antenna sub-assemblies 150, 180 may be manufactured through a variety of fabrication technologies. In the illustrated embodiment, the antenna sub-assemblies 150, 180 may be manufactured through known printed circuit board (PCB) technologies. The antenna sub-assemblies 150, 180 for such embodiments may be a laminate or sandwich structure that includes a plurality of stacked substrate layers. Each substrate layer may include, at least partially, an insulating dielectric material. By way of example, the substrate layers may include a dielectric material (e.g., flame-retardant epoxy-woven glass board (FR4), FR408, polyimide, polyimide glass, polyester, epoxy-aramid, metals, and the like); a bonding material (e.g., acrylic adhesive, modified epoxy, phenolic butyral, pressure-sensitive adhesive (PSA), preimpregnated material, and the like); a conductive material that is disposed, deposited, or etched in a predetermined manner; or a combination of the above. The conductive material may be copper (or a copper-alloy), cupro-nickel, silver epoxy, conductive polymer, and the like. It should be understood that substrate layers may include sub-layers of, for example, bonding material, conductive material, and/or dielectric material. As such, at least one of the antenna sub-assemblies 150, 180 may be a printed circuit and, more specifically, a printed circuit board.

It should be understood, however, that the antenna sub-assemblies 150, 180 may be manufactured through other methods. One or more elements of the antenna sub-assemblies 150, 180 may be manufactured through laser direct structuring (LDS), two-shot molding (dielectric with copper traces), and/or ink-printing. For example, structural components may be manufactured by molding a dielectric material (e.g., thermoplastic) into a designated shape. Conductive elements (e.g., traces) may then be disposed on surfaces of the mold through, for example, ink-printing. Alternatively, conductive elements may be first formed and then a dielectric material may be molded around the conductive components. For example, the conductive elements may be stamped from sheet metal, disposed within a cavity, and then surrounded by a thermoplastic material that is injected into the cavity.

As shown in FIGS. 3 and 4, each of the antenna sub-assemblies 150, 180 is oriented with respect to mutually perpendicular X, Y, and Z-axes. The Z-axis extends into and out of the page. It should be understood that the X, Y, and Z-axes are only used for reference in describing the positional relationship between different elements of the multi-band slot antenna. The X, Y, and Z-axes do not have any particular orientation with respect to gravity.

With respect to FIG. 3, the antenna sub-assembly 150 includes a dielectric body 152 and conductive elements 154, 156, 158 that are supported by the dielectric body 152. The conductive elements include a ground trace or pad 154, a feed trace or pad 156, and a parasitic trace or pad 158. The conductive elements may also include vias 155, 157 that extend through the dielectric body 152 or other traces. As used herein, a "via" is a conductive pathway. In an exemplary embodiment, the vias extend parallel to the Z-axis, but the vias are not required to in other embodiments, such as those that are molded.

In a specific embodiment, the ground trace 154, the feed trace 156, and the parasitic trace 158 are coplanar along an exterior surface 153 of the dielectric body 152. However, the ground trace 154, the feed trace 156, and the parasitic trace 158 are not required to be coplanar and are not required to be positioned along an exterior surface of the dielectric body 152. For example, in other embodiments, at least one of the ground trace 154, the feed trace 156, or the parasitic trace 158 may be embedded within the dielectric body 152. The ground trace 154, the feed trace 156, or the parasitic trace 158 may have different Z-positions (or positions relative to the Z-axis) with respect to one another. For example, the feed trace 156 and the parasitic trace 158 may have different Z-positions.

The dielectric body 152 has a first dimension (or length) 160 along the X axis and a second dimension (or width) 162 along the Y axis. In an exemplary embodiment, the dielectric body 152 is configured to be secured to another component, such as a dielectric insert 250 (shown in FIG. 7). In other embodiments, such as those in which the dielectric body 152 is molded, the features of the dielectric body 152 and the dielectric insert 150 may be combined and be essentially one unitary piece. The dielectric body 152 includes openings 164, 166 that are sized and shaped to receive hardware or respective projections. As shown, the openings 164, 166 are thru-holes of the dielectric body 152.

The feed trace 156 is coupled to a conductive pathway (e.g., coaxial cable) through a feed point 157. The feed point 157 may represent a location where a via interconnects the feed trace 156 to the conductive pathway. The conductive pathway may be terminated to another portion of the antenna sub-assembly 150. The conductive pathway is configured to communicate RF waves to the feed trace 156. The feed trace 156 is configured to be operably aligned with an antenna slot 190 (represented by a dashed box in FIG. 3), such as the antenna slot 212 (shown in FIG. 5), to communicate at a designated frequency band. The ground trace 154 is also aligned with the antenna slot 190. In an exemplary embodiment, the feed trace 156 is configured to communicate at two frequency bands, such as a frequency band centered at 2.4 GHz and a frequency band centered at 5-6 GHz (for example, at 5.3 or 5.6 GHz), although other frequency bands may be used. The ground trace 154 may be electrically coupled to a system ground (not shown). The ground trace 154 may also be electrically coupled to an outer conductor of the coaxial cable.

The parasitic trace 158 may also be operably aligned with the antenna slot such that the parasitic trace 158 provides capacitance across the antenna slot. The parasitic trace 158 is positioned relative to the feed trace 156 to at least one of (a) effectively modify the frequency band of the feed trace 156 or (b) enable the wireless device to communicate within an additional frequency band. The additional frequency band may be higher than the frequency band of the feed trace 156. For embodiments in which the feed trace 156 communicates at two frequency bands, the parasitic trace 158 may enable the wireless device to communicate at a third frequency band that is higher than at least one of the two frequency bands at which the feed trace 156 communicates.

In some embodiments, the parasitic trace 158 may operate as a passive resonator that absorbs the RF waves from the feed trace 156 and re-radiates the RF waves at a different frequency band. In particular embodiments, the feed trace 156 communicates at first and second frequency bands, wherein at least the first frequency band is modified by the parasitic trace 158 and the parasitic trace 158 communicates at a third frequency band. In some embodiments, the parasitic trace 158 may enable the use of shorter antenna slots. That is, the parasitic trace 158 permits a length of the antenna slot to be shorter compared to the length of the antenna slot if the multi-band slot antenna did not include the parasitic trace. As such, the parasitic trace 158 may enable a multi-frequency band that operates at three frequency bands (or more) using a shorter antenna slot than what would be necessary if the parasitic trace 158 did not exist.

The parasitic trace 158 may be sized and shaped so that the multi-band slot antenna achieves a designated performance. For example, a width 170 of the parasitic trace 158 may be controlled to control or determine the lower frequency band of the feed trace 156. A length 172 of the parasitic trace 158 may be controlled to select the frequency band of the parasitic trace 158. The feed trace 156 may also be dimensioned to determine the frequency band (or bands)

at which the feed trace 156 communicates. In addition to the above parameters, one or more gaps 174 between the parasitic trace 158 and the feed trace 156 may be configured to achieve a designated performance.

Although the illustrated embodiment shows only a single parasitic trace 158, embodiments may include more than one parasitic trace to further control the performance of the multi-band slot antenna.

With respect to FIG. 4, the antenna sub-assembly 180 may include features that are similar or identical to the antenna sub-assembly 150 (as described for FIG. 3, and the descriptions are not repeated here). For example, the antenna sub-assembly 180 may include a dielectric body 182 and conductive elements 184, 186, 188 that are supported by the dielectric body 182. The conductive elements include a ground trace or pad 184, a feed trace or pad 186, and a parasitic trace or pad 188. The conductive elements may also include vias that extend through the dielectric body 182 or other traces. For example, the feed trace 186 is coupled to a conductive pathway (e.g., coaxial cable) through a feed point 187. The feed point 187 may represent a location where a via interconnects the feed trace 186 to the conductive pathway.

An antenna slot (represented by dashed box 190 in FIG. 3 for antenna sub-assembly 150, or represented by dashed box 198 in FIG. 4 for antenna sub-assembly 180) is positioned over and on an opposite side of the corresponding antenna sub-assembly. As shown in FIG. 4, each of the feed trace 186 and the parasitic trace 188 have widths that are greater than a width 199 of the antenna slot 198. Depending upon the desired performance of the multi-band slot antenna, each of the feed trace 186 and the parasitic trace 188 may entirely overlap the antenna slot 198 across the width or only one of the feed trace 186 and the parasitic trace 188 may entirely overlap the antenna slot 198 across the width. For example, the parasitic trace 188 has a first outer edge 192 and a second outer edge 194 with a width 196 of the parasitic trace 188 extending therebetween along the Y-axis. As viewed in FIG. 4 along the Z-axis, the antenna slot 198 is positioned between the first and second outer edges 192, 194 such that the parasitic trace 188 entirely overlaps the antenna slot 198 along the Y-axis. In the illustrated embodiment, the feed trace 186 also entirely overlaps the antenna slot 198 along the Y-axis. In other embodiments, however, the parasitic trace 188 and the feed trace 186 do not entirely overlap the antenna slot 198. As shown in FIG. 3, the antenna slot 190 has a width 191 that is sized relative to the feed and parasitic traces 156, 158. The feed trace 156 entirely overlaps the antenna slot 190 and the parasitic trace 186 at least partially overlaps the antenna slot 190. Depending upon the desired performance of the multi-band slot antenna, the ground trace 154 may or may not overlap with the antenna slot 190.

Figure 5:
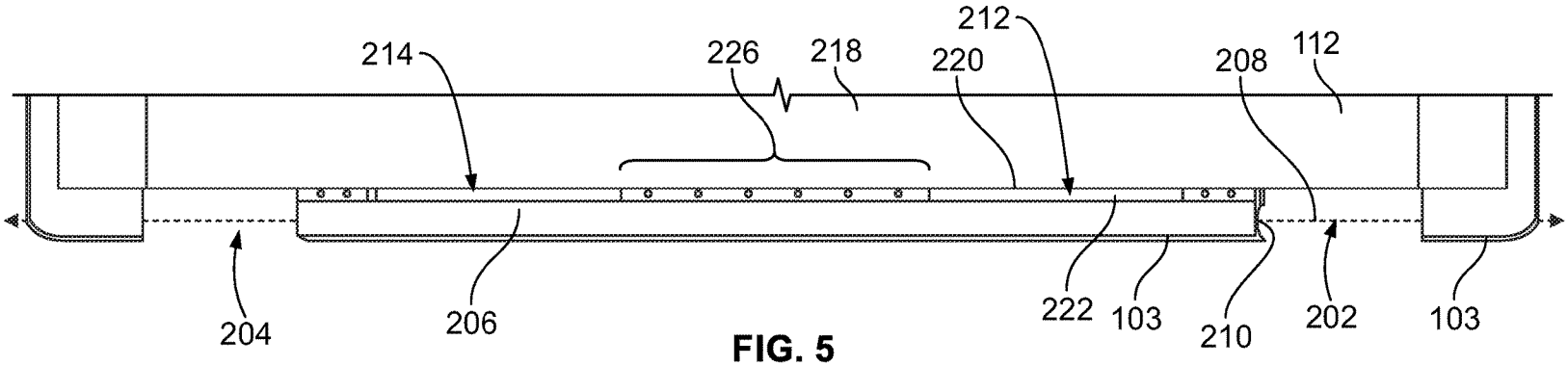
FIG. 5 is an enlarged rear view of a portion of the structural element including antenna slots of the wireless communication device of FIG. 1.

FIG. 5 is an enlarged back view of a portion of the cover shell 112 of the wireless device 100 of FIG. 1. The portion of the cover shell 112 in FIG. 5 may form part of the hinge assembly 106 (FIG. 1). The cover shell 112 is a structural element of the wireless device 100 as described above and is configured to protect and support the user display 114 (seen in FIG. 1). The first edge 103 is an edge of the cover shell 112. In the illustrated embodiment, the first edge 103 is a bottom exterior edge of the cover shell 112 that defines first and second recesses 202, 204. The first and second recesses 202, 204 are configured to receive complementary portions of the housing 118 (not shown). The first edge 103 also defines a hinge extension 206 that is positioned between the first and second recesses 202, 204. The hinge extension 206 has an inner contoured surface 210 that is shaped to form a rotatable engagement with a portion of the second device section 104 (FIG. 1).

As shown, the cover shell 112 includes a conductive material that forms first and second antenna slots 212, 214. As such, the cover shell 112 may constitute or include a conductive wall having the antenna slots 212, 214. The first and second antenna slots 212, 214 are defined by the hinge extension 206. The first and second antenna slots 212, 214 may extend along a boundary between the hinge extension 206 and a main section 218 of the cover shell 112. In the illustrated embodiment, the first and second antenna slots 212, 214 extend parallel to and adjacent to an axis of rotation 208. The axis of rotation 208 may be defined, at least in part, by the inner contoured surface 210. The first and second antenna slots 212, 214 may be, for example, within 4 centimeters (cm) of the axis of rotation 208 regardless of the position of the cover shell 112.

It should be understood, however, that the first and second antenna slots 212, 214 may have other locations in other embodiments. For example, the first and second antenna slots 212, 214 may be defined by an interior conductive wall that defines a portion of an interior frame of the wireless device 100. As used herein, the term "conductive wall" may include an exterior wall (e.g., the hinge extension 206) or may include an interior wall.

At least one of the first and second antenna slots 212, 214 may extend parallel to and proximate to the first edge 103. As used herein, the term "proximate to" includes the antenna slot being immediately adjacent to the first edge or within a designated distance from the first edge. For example, at least one of the first and second antenna slots 212, 214 may have a distal edge 220 that is within 4 cm of the first edge 103. In more particular embodiments, the distal edge 220 is within 2.5 cm of the first edge 103. At least one of the first and second antenna slots 212, 214 may have a proximal edge 222 that is within 2 centimeters of first edge 103. In more particular embodiments, the proximal edge 222 may be within 1.5 cm of the first edge 103. As shown in FIG. 5, the first and second antenna slots 212, 214 are spaced apart by a separation distance 226.

Figure 6:
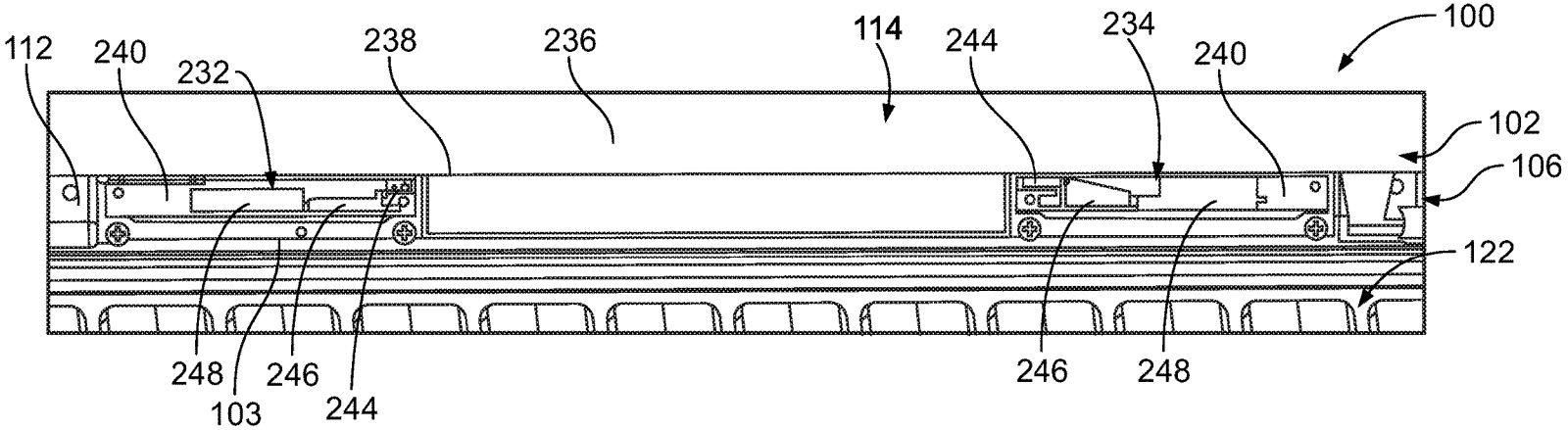
FIG. 6 is an enlarged front view of a portion of the wireless communication device that illustrates the first and second multi-band slot antennas of FIG. 1.

FIG. 6 is an enlarged front view of a portion (near hinge assembly 106) of the wireless device 100 when in the open operating state and the user is facing the user display 114 and the user interface 122. For illustrative purposes, a portion of the first device section 102 has been removed to expose first and second antenna sub-assemblies 232, 234 and a substrate 236 (e.g., glass) of the user display 114. The first and second antenna sub-assemblies 232, 234 are positioned between a proximal edge 238 of the substrate 236 and the first edge 103 of the cover shell 112. As shown, the first and second antenna sub-assemblies 232, 234 include respective printed circuits 240 having conductive elements 244, 246, 248 that face inwardly toward the user.

Figure 7:
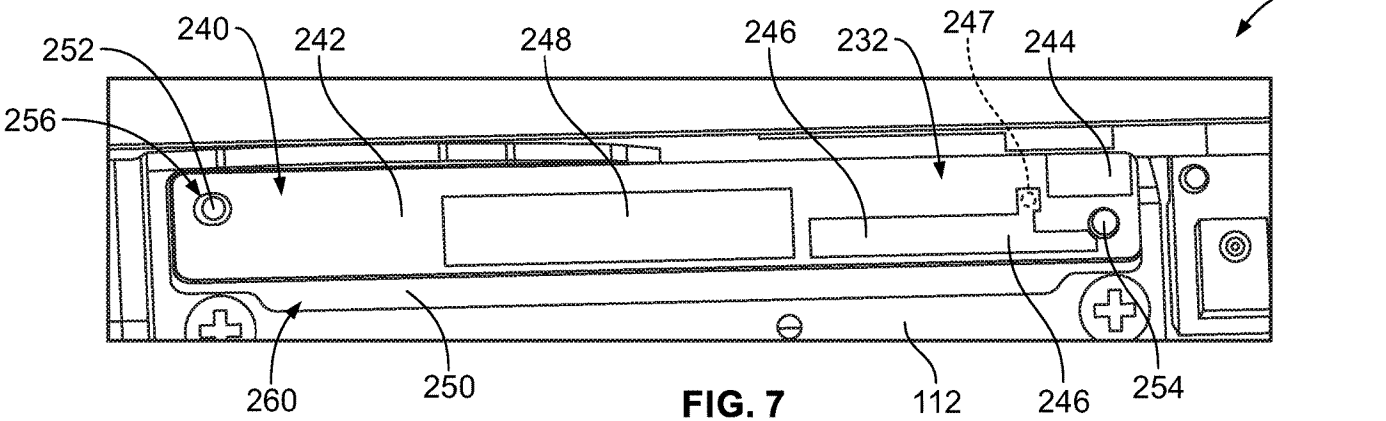
FIG. 7 is an enlarged view of the first multi-band slot antenna that may be used with the wireless communication device of FIG. 1, according to another specific embodiment.
Figure 8:
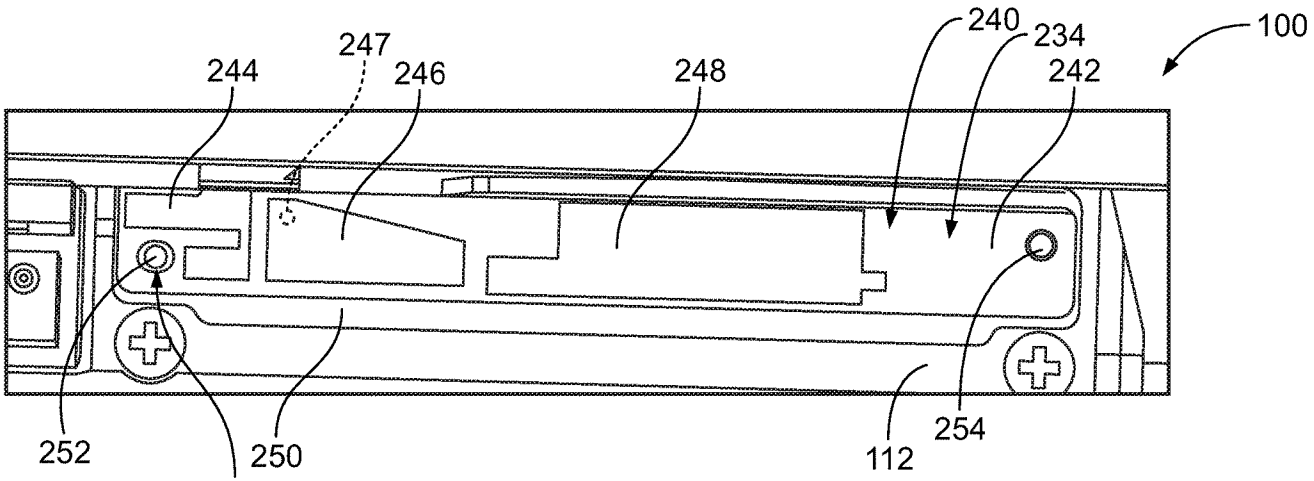
FIG. 8 is an enlarged view of the second multi-band slot antenna that may be used with the wireless communication device of FIG. 1, according to another specific embodiment.

FIGS. 7 and 8 are enlarged views of the first and second antenna sub-assemblies 232, 234, respectively, according to other specific embodiments. Each of the first and second antenna sub-assemblies 232, 234 includes a dielectric body 242 of the printed circuit 240 and a dielectric insert 250. The dielectric body 242 supports a ground trace 244, a feed trace 246, and a parasitic trace 248, which may be similar or identical to the ground trace 154, the feed trace 156, and the parasitic trace 158, respectively, of FIG. 3. Each of the feed traces 246 has a feed point 247, which may represent a location where a via interconnects the feed trace 246 to a conductive pathway (not shown).

In some embodiments, the dielectric insert 250 is a molded structure that is configured to couple to the cover shell 112 or other housing structure of the wireless device 100. The dielectric insert 250 may include posts 252, 254 that extend through respective thru-holes 256 of the dielectric bodies 242 to secure the printed circuits 240 to the respective dielectric insert 250. Although FIGS. 7 and 8 illustrate the dielectric body 250 and the dielectric insert 252 being discrete elements, it is contemplated that the features of the dielectric body 250 and the dielectric insert 252 may be combined into a single structure (e.g., molded structure). In such cases, the single molded structure may be referred to as a dielectric body or a dielectric insert.

Figure 9:
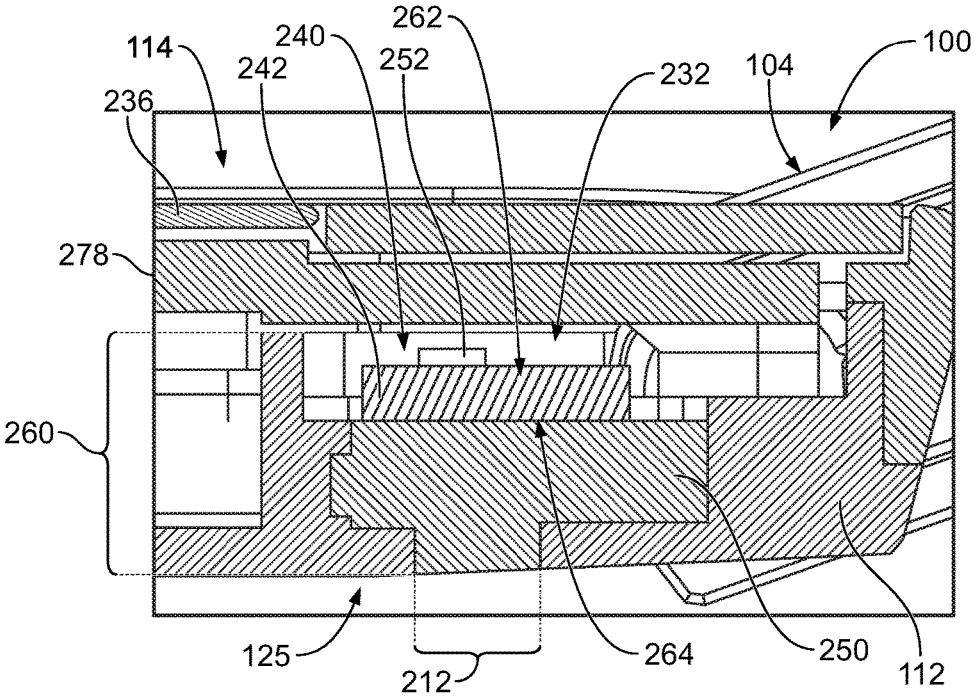
FIG. 9 is an enlarged cross-sectional view of a housing cavity having at least one of the first and second multi-band slot antennas disposed therein for the wireless communication device of FIG. 1.

FIG. 9 is an enlarged cross-sectional view of a portion of (near the hinge assembly 106) of the wireless device 100 and shows the first antenna sub-assembly 232 within the housing cavity 260. The housing cavity 260 is defined by a planar cover 278 and the cover shell 112. The cover shell 112 may essentially define a volume of the housing cavity 260 and the planar cover 278 may cover the volume. In some embodiments, the planar cover 278 may be a part of the user display 114 and support the substrate 236.

The first antenna slot 212 defines an opening to the housing cavity 260. When operably aligned with the antenna slot 212, as shown in FIG. 9, the first antenna sub-assembly 232 and the antenna slot 212 form the multi-band slot antenna 125. In some embodiments, the dielectric insert 250 may be molded with the cover shell 112 (or other housing section as the case may be) and, after the molding process, the printed circuit 240 may be mounted to the dielectric insert 250. For example, the dielectric body 242 has a top side 262 that faces away from the dielectric insert 250 and a bottom side 264 that engages the dielectric insert 250. The bottom side 264 may have an adhesive applied thereto and/or the dielectric insert 250 may have an adhesive applied thereto. The printed circuit 240 may then be mounted to the dielectric insert 250. The post 252 may facilitate aligning the printed circuit 240 as it is mounted thereto.

Alternatively, the first antenna sub-assembly 232 may be separately assembled and then positioned, as a unit, within the housing cavity 260 such that the dielectric insert 250 forms an interference fit with the cover shell 112 (or other housing section as the case may be). Accordingly, the dielectric insert 250 may be either separately positioned within the housing cavity 260 and form an interference fit with the cover shell 112 or may be molded with or into the cover shell 112. As such, the conductive elements 244, 246, 248 (FIG. 8) may have essentially fixed positions relative to the respective antenna slot 212.

Figure 10:
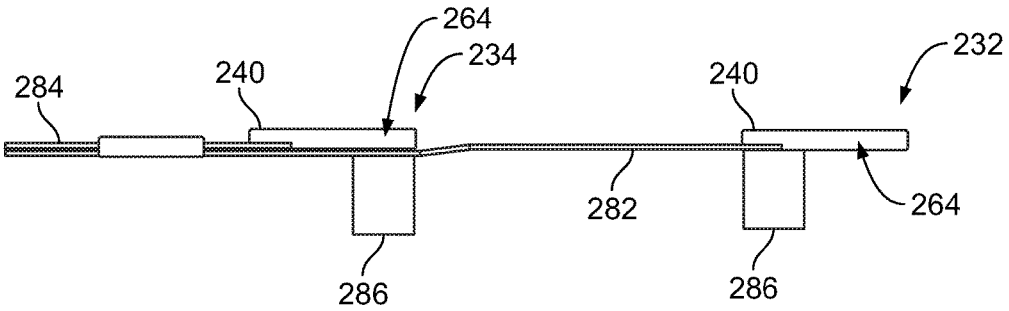
FIG. 10 is an isolated view of the first and second multi-band slot antennas communicatively coupled to coaxial cables of the wireless communication device of FIG. 1.

FIG. 10 is an isolated view of the first and second antenna sub-assemblies 232, 234 when communicatively coupled to coaxial cables 282, 284, respectively. FIG. 10 shows the bottom sides 264 of the respective printed circuits 240. As shown, the coaxial cable 282 (or conductive pathway 282) may be terminated to the bottom side 264 of the printed circuit 240 of the first antenna sub-assembly 232, and the coaxial cable 284 (or conductive pathway 284) may be terminated to the bottom side 264 of the printed circuit 240 of the second antenna sub-assembly 234. In an exemplary embodiment, the coaxial cables 282, 284 may extend essentially parallel to the axis of rotation 208 (FIG. 5). However, the coaxial cables 282, 284 may approach the printed circuits 240 in other directions. Also shown, the first and second antenna sub-assemblies 232, 234 may be electrically coupled to ground foils 286.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112(f), unless and until such claim limitations expressly use the phrase "means for" followed by a statement of function void of further structure.

What is claimed is:

1. A wireless communication device comprising:

a conductive wall having an antenna slot; and an antenna sub-assembly positioned relative to the antenna slot to form a multi-band slot antenna, the multi-band slot antenna comprising:

a dielectric body;

a feed trace coupled to the dielectric body and electrically coupled to a conductive pathway for communicating radio-frequency (RF) waves, the feed trace being operably aligned with the antenna slot; and a parasitic trace coupled to the dielectric body, the parasitic trace being operably aligned with the antenna slot and spaced apart from the feed trace;

wherein the feed trace is configured to communicate at a first frequency band and the parasitic trace provides capacitance across the antenna slot and enables the multi-band slot antenna to communicate at a second frequency band, the first frequency band being based on a size and shape of the parasitic trace.

2. The wireless communication device of claim 1, wherein the feed trace is configured to communicate at a third frequency band, the second and third frequency bands being greater than the first frequency band, the feed trace overlapping the antenna slot.

3. The wireless communication device of claim 1, wherein the parasitic trace permits a length of the antenna slot to be shorter compared to the length of the antenna slot if the multi-band slot antenna did not include the parasitic trace.

4. The wireless communication device of claim 1, further comprising a housing section that defines an exterior of the wireless communication device, the housing section including the conductive wall and the antenna slot, the conductive wall being a structural element of the wireless communication device and having wall edges that define an entirety of the antenna slot.

5. The wireless communication device of claim 4, wherein the antenna slot opens to the exterior of the wireless communication device.

6. The wireless communication device of claim 4, wherein the housing section defines a housing cavity, the dielectric body including a dielectric insert that is either disposed in the housing cavity and engaging the housing section through an interference fit or molded with the housing section.

7. The wireless communication device of claim 4, further comprising a cover shell that includes the housing section and a user display that is protected by the cover shell.

8. The wireless communication device of claim 1, further comprising a printed circuit that includes the dielectric body, the feed trace, and the parasitic trace, the printed circuit overlapping with the antenna slot.

9. The wireless communication device of claim 1, wherein the multi-band slot antenna is a first multi-band slot antenna, the wireless communication device including a second multi-band slot antenna, the second multi-band slot antenna including a corresponding antenna slot, a corresponding feed trace, and a corresponding parasitic trace.

10. A multi-band slot antenna comprising:

a conductive wall having an antenna slot;

a dielectric body;

a feed trace coupled to the dielectric body and configured to be electrically coupled to a conductive pathway for communicating radio-frequency (RF) waves, the feed trace being operably aligned with the antenna slot; and a parasitic trace coupled to the dielectric body, the parasitic trace being operably aligned with the antenna slot and spaced apart from the feed trace;

wherein the feed trace is configured to communicate at a first frequency band and the parasitic trace provides capacitance across the antenna slot and enables the multi-band slot antenna to communicate at a second frequency band, the first frequency band being based on a size and shape of the parasitic trace.

11. The multi-band slot antenna of claim 10, wherein the feed trace is configured to communicate at a third frequency band, the second and third frequency bands being greater than the first frequency band.

12. The multi-band slot antenna of claim 10, wherein the parasitic trace permits a length of the antenna slot to be shorter compared to the length of the antenna slot if the multi-band slot antenna did not include the parasitic trace.

13. The multi-band slot antenna of claim 10, wherein the conductive wall is a portion of a housing section of a wireless communication device.

14. The multi-band slot antenna of claim 10, further comprising a printed circuit that includes the dielectric body, the feed trace, and the parasitic trace, wherein the feed trace and the parasitic trace are coplanar.

15. An antenna sub-assembly comprising:

a dielectric body;

a feed trace coupled to the dielectric body and configured to be electrically coupled to a conductive pathway for communicating radio-frequency (RF) waves; and a parasitic trace coupled to the dielectric body, the parasitic trace being spaced apart from the feed trace and having a fixed position with respect to the feed trace, the parasitic trace being an ungrounded floating parasitic trace that operates as a passive resonator that absorbs RF waves from the feed trace and re-radiates the RF waves at a different frequency band;

wherein the feed trace and the parasitic trace are configured to be operably positioned relative to a common antenna slot to form a multi-band slot antenna, the feed trace being configured to communicate at a first frequency band, the parasitic trace enabling the multi-band slot antenna to communicate at a second frequency band, the first frequency band being based on a size and shape of the parasitic trace.

16. The antenna sub-assembly of claim 15, wherein the feed trace is configured to communicate at a third frequency band, the second and third frequency bands being greater than the first frequency band.

17. The wireless communication device of claim 1, wherein the parasitic trace operates as a passive resonator that absorbs RF waves from the feed trace and re-radiates the RF waves at a different frequency band.

18. The wireless communication device of claim 1, wherein the antenna slot is a closed antenna slot that is defined by the conductive wall, the antenna slot having a width and a length, each of the feed trace and the parasitic trace extending entirely across the width of the antenna slot, the parasitic trace being an ungrounded floating parasitic trace that operates as a passive resonator that absorbs RF waves from the feed trace and re-radiates the RF waves at a different frequency band.

19. The wireless communication device of claim 1, further comprising a housing having a hinge extension, the antenna slot being defined by the hinge extension.

20. The multi-band slot antenna of claim 10, wherein the antenna slot extends lengthwise along a proximal edge and distal edge and is closed at both ends by the conductive wall, the antenna slot having a width and a length that is greater than the width, each of the feed trace and the parasitic trace extending entirely across the width of the antenna slot.

* * * * *